US005886599A

United States Patent [19]

Solveson et al.

[11] Patent Number: 5,886,599

[45] Date of Patent: Mar. 23, 1999

[54] MOLDED CASE CIRCUIT BREAKER HAVING AN IMPROVED ELECTROMAGNETIC TRIP

[75] Inventors: Mark George Solveson, Oconomowoc; Hemant Kumar Mody, Brookfield; Mary Jo J. Vanderheiden, Hubertus; Charles Joseph Tennies, Waukesha; Mark Allan Juds, New Berlin; Peter Klaus Moldovan, Cascade, all of Wis.

[73] Assignee: Eaton Corporation, Cleveland, Ohio

[21] Appl. No.: 990,959

[22] Filed: Dec. 15, 1997

[51] Int. Cl.[6] ..... H01H 75/12

[52] U.S. Cl. ..... 335/35; 335/172; 335/23

[58] Field of Search ..... 335/23–25, 35–48, 335/167–176

[56] References Cited

U.S. PATENT DOCUMENTS 713,887 11/1902 Johnston ..... 335/38

4,220,935 9/1980 Wafer et al. .

4,503,408 3/1985 Mrenna et al. .

4,528,531 7/1985 Flick et al. .

*Primary Examiner*—Lincoln Donovan

*Attorney, Agent, or Firm*—Martin J. Moran

[57] ABSTRACT

An improved circuit interrupter having a solenoid in series with the line and load terminals with an armature operable to activate a trip mechanism within the circuit breaker upon experiencing current levels indicative of short circuit conditions. The traditional solenoid coil is replaced with a free form conductor stamped in a serpentine pattern with adjacent legs deformed slightly in opposite directions to permit an electromagnetic material to be disposed therebetween. Current is directed through the conductor progressively back and forth through the serpentine pattern and creates a magnetic field in the electromagnetic material which is sufficient to activate an armature when current levels approximate short circuit conditions.

6 Claims, 3 Drawing Sheets

MOLDED CASE CIRCUIT BREAKER HAVING AN IMPROVED ELECTROMAGNETIC TRIP

BACKGROUND OF THE INVENTION

1. Field of the Invention

This invention relates generally to circuit breakers having a magnetic trip assembly in which the magnetic field induced by an abnormal current unlatches a latchable operating mechanism to trip the breaker, and more particularly, to such a magnetic trip assembly which employs a solenoid to translate the magnetic field into mechanical movement to cause actuation of trip mechanism.

2. Background Information

Circuit breakers provide protection for electrical systems from electrical fault conditions such as current overloads and short circuits. A common type of circuit breaker used to interrupt abnormal conditions in an electrical system incorporates a thermal trip device which responds to persistent low levels of overcurrent and a magnetic trip assembly which responds to higher levels of overcurrent in a fraction of a second. An example of such a circuit breaker is disclosed in U.S. Pat. No. 4,528,531. In such circuit breakers, the thermal trip device comprises a bimetal which bends in response to a persistent low level overcurrent passing through it to unlatch a latchable operating mechanism. The latchable operating mechanism is spring operated to open electrical contacts which interrupt the current. In a large number of commercial circuit breakers a rotatable trip bar is provided to initiate the unlatching of the latchable operating mechanism in response to either the electrothermal stimulus or an electromagnetic stimulus. The electrothermal stimulus is related to $I^2t=K$; or stated another way, the amount of overload current present over a predetermined period of time. The electromagnetic stimulus is related to short circuit conditions, sometimes referred to as an instantaneous tripping situation. Generally, the calibration of the electrothermal stimulus is related the angular swing through which the trip bar rotates in response to impingement thereon by the bimetallic member. On the other hand, response to the short circuit condition is related to how quickly an armature can be attracted to an electromagnetic member. In each case, the current flowing in the main terminals of the circuit breaker provides input into the electrothermal or electromagnetic response. As the size of the circuit breaker apparatus is reduced during miniaturization, the need for a highly calibrated, rugged and repeatable electromagnetic trip mechanism exists, that can reduce manufacturing costs.

SUMMARY OF THE INVENTION

An improved electromagnetic coil for the solenoid of a circuit breaker electromagnetic trip mechanism, formed from a flat sheet of electrically conductive material that is cut in a serpentine pattern. The adjacent legs of the serpentine pattern are deformed in opposite directions so that a segment of electromagnetic material can be inserted therebetween. Each end of the serpentine pattern is connected in series with the load and line terminals so that current flowing progressively back and forth through the legs of the serpentine pattern sets up a magnetic field in the electromagnetic material disposed between the legs. The magnetic force that is set up in the electromagnetic material is employed to actuate an armature which in turn causes rotation of a trip bar to open the circuit breaker contacts.

BRIEF DESCRIPTION OF THE DRAWINGS

For a better understanding of the invention, reference may be had to the preferred embodiment shown in the accompanying drawings in which.

DESCRIPTION OF THE PREFERRED EMBODIMENTS

Figure 1:
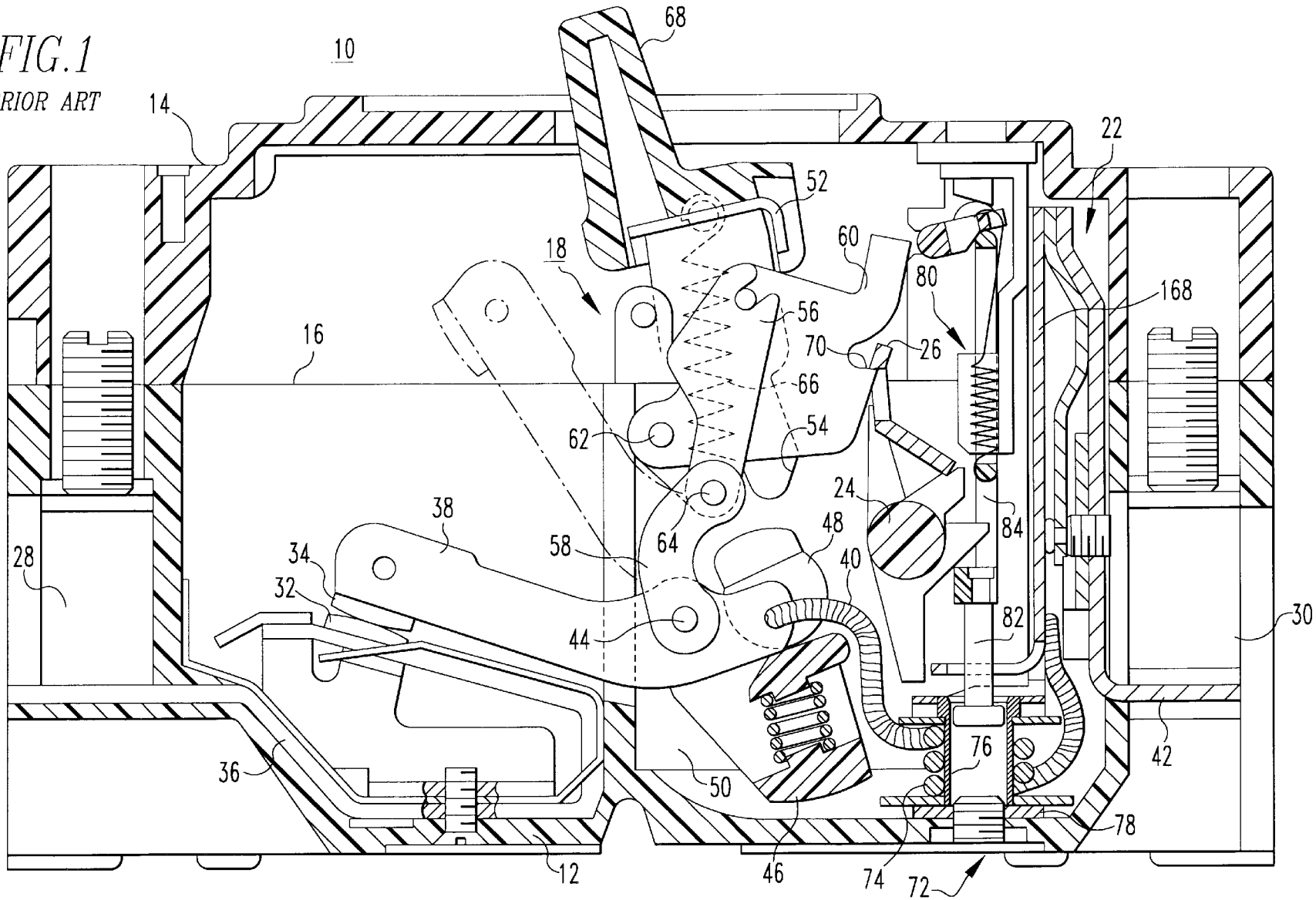
FIG. 1 PRIOR ART
FIG. 1 is a longitudinal cross section through a circuit breaker in accordance with the prior art.

In FIG. 1, a molded case circuit breaker generally indicated at 10 comprises an insulated housing or base 12 having a cover 14 which is mechanically attached at a parting line 16 and retained in place by a plurality of fasteners, such as screws (not shown). The circuit breaker may be of a single or multiple pole construction. The latter construction comprises insulating barriers separating the interior of the housing into adjacent side by side pole unit compartments in a well known manner. For a multipole unit, such as a 3 pole circuit breaker, a latchable operating mechanism 18 is disposed in the center pole unit. However, each pole unit includes a separate thermal and magnetic trip device 22 for rotating a common trip bar 24 which in turn releases a latch lever 26 on the latchable operating mechanism 18.

For a poly phase circuit breaker, a pair of similar terminals including line terminal 28 and load terminal 30, at opposite ends of the breaker 10, are provided for each phase. The respective terminals 28 and 30 electrically connect the circuit breaker 10 in series with each phase of an electrical circuit, to protect the electrical system involved.

The circuit breaker 10 is disclosed in FIG. 1 in the closed position with a pair of separable contacts including a fixed contact 32 and a moveable contact 34 in electrical contact with each other. In that position, a circuit through the circuit breaker extends from the line terminal 28 through a conductor 36, the contacts 32, 34, a contact arm 38, a shunt 40, the trip unit 22, and a conductor 42 to the load terminal 30.

The contact arm 38 is pivotally connected at a pin 44 to a rotatable carriage 46, which is secured to or integral with a crossbar 48. The contact arm 38 and the carriage 46 rotate as a unit with the crossbar 48 during normal current conditions through the circuit breaker 10. The spring powered operating mechanism 18 is typical of that set forth in U.S. Pat. No. 4,503,408 for which reason it is not described herein in detail. In general, the mechanism 18 is positioned between spaced plates 50 (one of which is shown) which are fixedly secured to base 12 of the center pole unit. An inverted U-shaped operating lever 52 is pivotally supported in U-shaped notches 54 on the plates with the ends of the legs of the lever supported on the notches 54 in the plates.

The operating mechanism 18 includes an overcenter toggle having an upper toggle link 56 and a lower toggle link 58 which connect the arm 38 to a releasable cradle member 60 that is pivotally supported on the plates 50 by a pin 62. The toggle links 58, 56 are pivotally connected by means of a knee pivot pin 64. Overcenter operating springs 66 are connected under tension between the knee pivot pin 64 and the bite portion of the lever 52. A handle 68 is mounted on the upper end of the lever 52 for manual operation of the operating mechanism 18.

Contacts 32, 34 are normally manually separated by movement of the handle 68 to the right from the ON position shown in FIG. 1 to an OFF position. However, they can also be opened automatically by the trip unit 22 through the trip bar 24 and latch lever 26 which engages a notch 70 in the cradle member 60. For the purpose of this invention, the circuit breaker operation mechanism 18 is shown as being tripped solely by the trip unit 22. Other means for tripping such as separate high speed electromagnetic trip devices are described elsewhere such as in U.S. Pat. No. 4,220,935.

Figure 2:
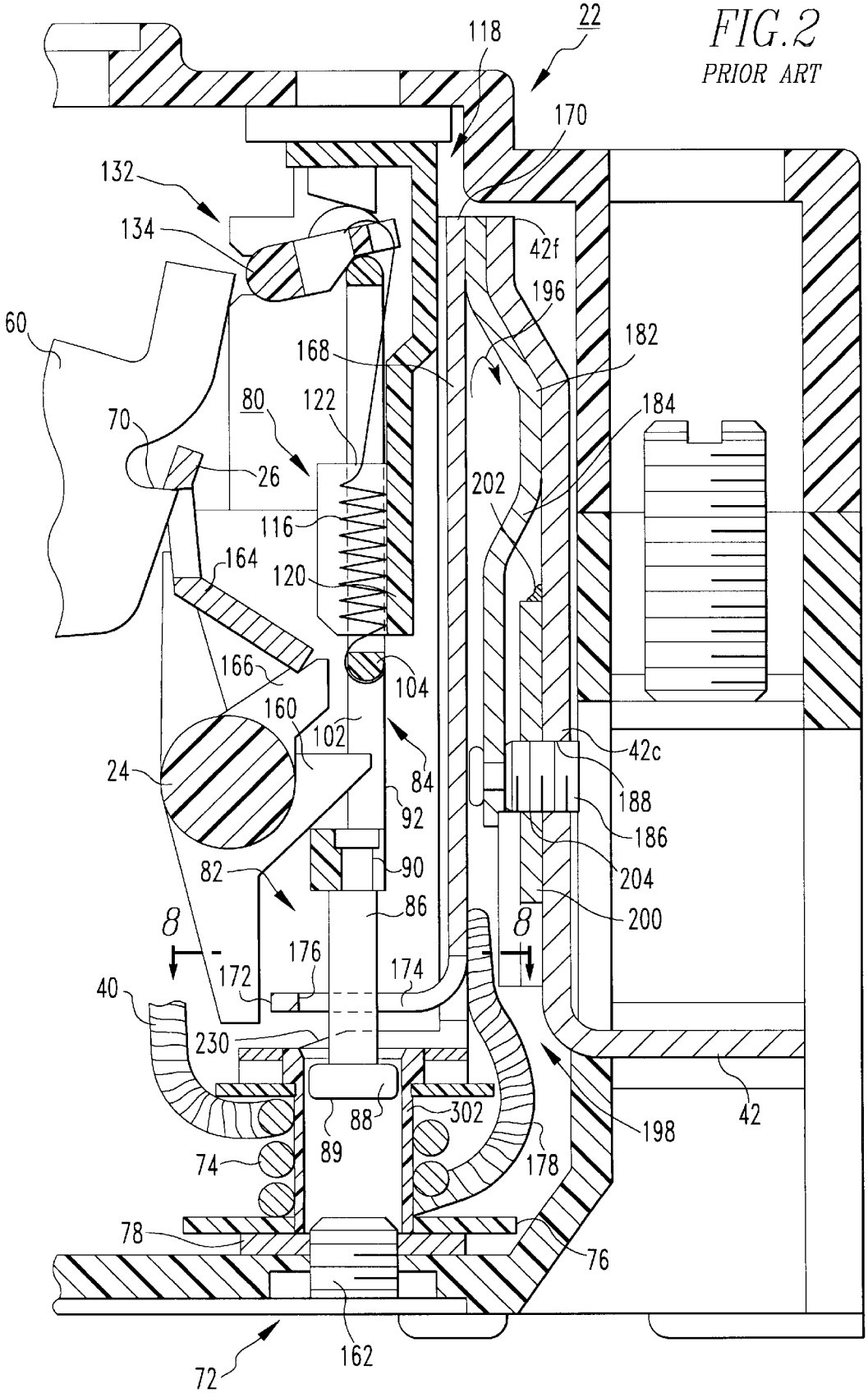
FIG. 2 PRIOR ART
FIG. 2 illustrates, in a larger scale, the trip unit which forms a part of the circuit breaker of FIG. 1.
Figure 3:
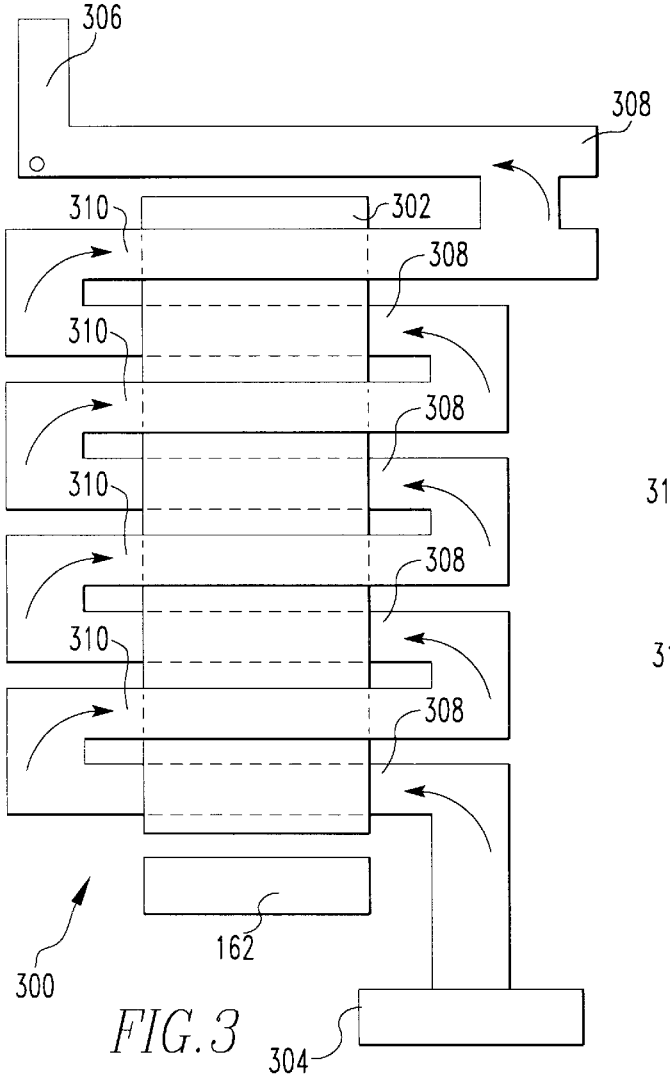
FIG. 3 is a plane view of one embodiment of the electromagnetic coil of this invention.
Figure 4:
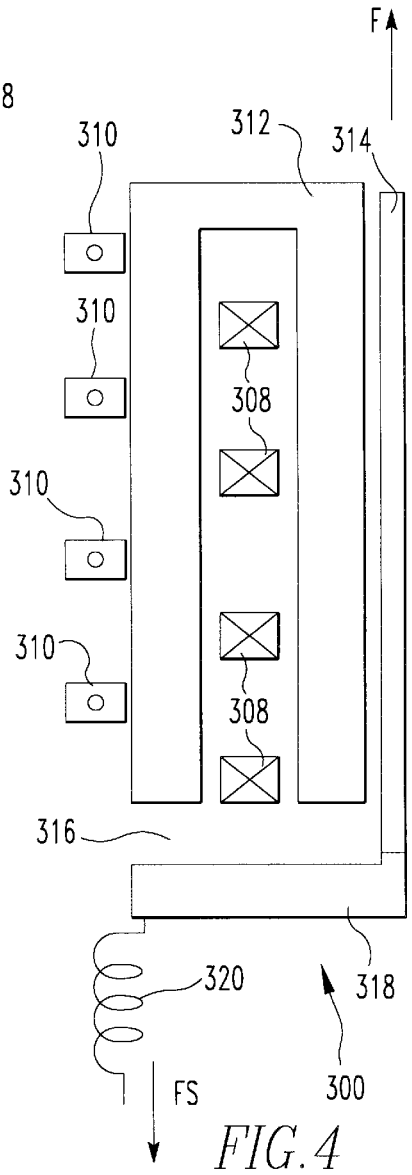
FIG. 4 illustrates a second embodiment of the magnetic coil of this invention.

The trip unit 22 is an adjustable thermomagnetic trip device. As best seen in FIGS. 2 through 4, the magnetic trip function is performed by an electromagnetic assembly 72 which includes a conventional coil 74 wound on a bobbin 76 and mounted inside a magnetic frame 78. As will be appreciated hereafter, the improvement of this invention is intended to replace the conventional coil and bobbin 76. However, the remainder of the trip mechanism can be employed as configured in co-pending application Ser. No. 08/839,530, filed Apr. 14, 1997 (Eaton Docket 96-PDC-292). Referring again to FIG. 2, the electromagnetic assembly 72 further includes an armature 80. This armature 80 includes an elongated armature element 82 and a frame 84. The elongated armature element 82 includes a cylindrical shaft 86 with an enlarged, cylindrical slug 88 at the lower, proximal end 89 and an annular groove 90 adjacent the upper end. A more detailed description can be found in co-pending application Ser. No. 08/839,530 (96-PDC-292), assigned to the assignee of this invention.

Referring again to FIG. 2, the trip bar 24 includes trip arms 160 for each pole which project into the openings 102 in the frames 84. With the armature biased up against the positioning bar 134 by the spring 116, there is a space between the engagement surface 104 on the armature and the associated trip arm 24. When the current through coil 74 exceeds the magnetic trip current, the magnetic force generated by this current draws the plunger 82 downward into the coil toward a calibration plug 162 threaded into the bottom of the magnetic frame 78. As the armature 80 is drawn down, the engagement surface 104 contacts the trip arm 160 and rotates the trip bar clockwise as shown in FIG. 2. As the trip rotates, a secondary latch plate 164 is released by the latch arm 166 on the trip bar. This in turn allows the latch lever 26 to unlatch the operating mechanism which then rapidly opens the main contacts in a manner well known. The thermal trip function of the trip unit 22 is performed by the bimetal 168 which also functions in a similar manner well known and more fully described in application Ser. No. 08/839,530, referenced above.

In accordance with this invention the solenoid coil 74 is replaced with a free form conductor that is configured in a serpentine design shown by reference character 300 in FIGS. 3 and 4. The term free form is used to describe a conductor assembly that will maintain its shape without the need of a bobbin form. Adjacent legs 308 and 310 of the serpentine pattern are deformed in opposite directions to permit the insertion of an electromagnetic member 302 therebetween. The electromagnetic member 302 can be a cylinder as shown in FIG. 2 to guide the movement of the armature member 88. The end of the serpentine conductor 304 is attached to the flexible connector 40 and the opposite end of the serpentine member 306 is connected to the flexible conductor 178 to complete the circuit. Current travelling through the serpentine member as shown in FIG. 3 sets up a magnetic field in the electromagnetic member 302 which causes the armature 88 shown in FIG. 2 to close the air gap between the member 88 and 162 driving down the armature as previously described. Preferably the serpentine member 300 is constructed from a flat sheet of conductive material that is stamped into the serpentine design. In one preferred embodiment the legs 308 and 310 are deformed into semicircles in opposite directions to closely receive the cylindrical member 302 therebetween. In this way a more ruggedized coil is obtained that is simpler and less costly to manufacture. FIG. 4 illustrates a second embodiment of this invention that does not require the serpentine legs to be deformed in a circular pattern. Adjacent legs are merely spread in separate directions far enough apart for one leg of a U-shaped magnetic frame to be interposed therebetween as shown by reference character 312. The armature 314 travels outside the other leg of the U-shaped frame 312. The magnetic forces within the frame force the gap 316 between the frame and the armature to cause the lower end 318 of the armature 314 to abut against the frame 312. The armature is normally biased in the open position, figuratively shown by the spring 320, however, it should be appreciated that in the embodiment described previously, the armature 80 would be appended as an extension of the base 318.

While specific embodiments of the invention have been described in detail, it will appreciated by those skilled in the art that various modifications and alternatives to those details could be developed in light of the overall teachings of the disclosure. Accordingly, the particularly arrangements disclosed are meant to be illustrative only and not limiting as to the scope of invention which is to be given the full breadth of the claims appended and any and all equivalents thereof.

What is claimed is:

1. A circuit interrupter including an electromagnetic trip unit comprising:

a fixed electrical contact;

a movable electrical contact having a first and second nonnally stable states, the first stable state in electrical conductive communication with the fixed contact and the second stable state separated from the fixed contact a given distance sufficient to interrupt continuous electrical conduction;

a moveable contact arm for effecting movement of the moveable contact about a pivot, the contact arm extending on both sides of the pivot;

a trip actuation mechanism responsive to an external force to move the moveable arm about the pivot to cause the moveable contact to move from the first stable state to the second stable state;

a solenoid armature positioned and moveable along an axis a sufficient length to cause the external force to be imparted to the trip actuation mechanism to move the moveable contact from the first stable state to the second stable state; and a continuous free form conductor, formed in a serpentine pattern cut from a flat sheet of electrically conductive material and positioned adiacent to the armature in a manner to direct current flowing in the conductor in a spiral path in a direction to create a magnetic field capable of driving the armature along its axis of movement to cause the external force to be imparted to the trip actuation mechanism, and connected in series with the moveable contact and the load.

2. The circuit interrupter of claim 1 wherein the continuous free formed conductor is formed from a flat sheet of metal that is stamped into a serpentine pattern.

3. The circuit interrupter of claim 1 wherein adjacent legs of the serpentine pattern are deformed into a tubular shape having a longitudinal center line that forms the axis of movement of the armature, wherein the legs of the serpentine pattern perpendicular to the axis surround the armature.

4. The circuit interrupter of claim 1 including means for returning the armature to a neutral position when current is not flowing through the conductor.

5. The circuit interrupter of claim 1 including a "U" shaped magnetic frame wherein adjacent legs of the serpentine pattern of the conductor are inserted on either side of one leg of the frame and the armature is "L" shaped having the base of the "L" attracted to the open end of the frame and its axis of travel parallel to one or the other leg of the frame.

6. The circuit interrupter of claim 5 wherein the axis of travel of the armature is parallel to the other leg of the frame.

* * * * *